US006520629B1

(12) United States Patent
Sharma et al.

(10) Patent No.: US 6,520,629 B1
(45) Date of Patent: Feb. 18, 2003

(54) STEERING FLUID DEVICE AND METHOD FOR INCREASING THE ANGLE OF DEFLECTION OF INK DROPLETS GENERATED BY AN ASYMMETRIC HEAT-TYPE INKJET PRINTER

(75) Inventors: Ravi Sharma, Fairport, NY (US); John A. Lebens, Rush, NY (US); Christopher N. Delametter, Rochester, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/675,831

(22) Filed: Sep. 29, 2000

(51) Int. Cl.[7] ..... B41J 2/09
(52) U.S. Cl. ..... 347/82; 347/77
(58) Field of Search ..... 347/82, 77, 21, 347/40

(56) References Cited

U.S. PATENT DOCUMENTS

| | | | | |
|---|---|---|---|---|
| 1,941,001 A | | 12/1933 | Hansell | |
| 4,106,032 A | * | 8/1978 | Miura et al. | 347/21 |
| 4,196,437 A | * | 4/1980 | Hertz | 347/98 |
| 5,963,235 A | | 10/1999 | Chwalek et al. | |
| 5,966,154 A | * | 10/1999 | DeBoer | 347/82 |
| 6,012,805 A | | 1/2000 | Hawkins et al. | |
| 6,065,825 A | * | 5/2000 | Anagnostopoulos et al. | 347/21 X |
| 6,079,821 A | | 6/2000 | Chwalek et al. | |
| 6,254,225 B1 | | 5/2001 | Chwalek et al. | 347/82 |

FOREIGN PATENT DOCUMENTS

| | | | | |
|---|---|---|---|---|
| EP | 1016526 A1 | | 5/2000 | |
| JP | 405177843 A | * | 7/1993 | 347/82 |

* cited by examiner

*Primary Examiner*—Huan Tran
(74) *Attorney, Agent, or Firm*—Walter S. Stevens

(57) ABSTRACT

An asymmetric heat-type inkjet printer includes an inkjet printhead having at least one nozzle for continuously ejecting a stream of ink that forms a train of ink droplets, a heater disposed adjacent to the nozzle for selectively thermally deflecting the droplet forming stream of ink either toward a printing medium, or an ink gutter that captures and recirculates the ink. To increase the angle of deflection that the intermittently operated heater imposes on the droplet-forming stream of ink, a steering fluid assembly is provided in communication with the inkjet nozzle for co-extruding a thin film of fluid around the ink which has a higher volatility and a lower thermal diffusivity than the liquid forming the ink. When the ink is water based, the steering fluid may be, for example, polyethylene oxide based surfactant, or isopropanol. The invention allows water-based ink droplets in such printers to be deflected at greater angles in response to heat pulses generated by the heater, thereby enhancing printing accuracy and speed.

24 Claims, 5 Drawing Sheets

STEERING FLUID DEVICE AND METHOD FOR INCREASING THE ANGLE OF DEFLECTION OF INK DROPLETS GENERATED BY AN ASYMMETRIC HEAT-TYPE INKJET PRINTER

FIELD OF THE INVENTION

This invention generally relates to a steering fluid device and method for use in an asymmetric heat-type inkjet printer that increases the angle of deflection of the ink droplets generated by the nozzles in the printhead.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and inkjet printers. However, at present, such electronic printing systems have not significantly replaced mechanical presses, even though this conventional method requires very expensive set up and is seldom commercially viable unless a few thousand copies of a particular page are to be printed. Thus, there is a need for improved digitally controlled printing systems that are able to produce high quality color images at a high speed and low cost using standard paper.

Inkjet printing is a prominent contender in the digitally controlled electronic printing arena because, e.g., of its non-impact low-noise characteristics, its use of plain paper, and its avoidance of toner transfers and fixing. Inkjet printing mechanisms can be categorized as either continuous inkjet or drop on demand inkjet. Continuous inkjet printing dates back to a least 1929. See U.S. Pat. No. 1,941,001 to Hansell.

Conventional continuous inkjets utilize electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a Acatcher@) may be used to intercept the charged drops, while the uncharged drops are free to strike the recording medium.

A novel continuous inkjet printer is described and claimed in U.S. patent application Ser. No. 08/954,317 filed Oct. 17, 1997, and assigned to the Eastman Kodak Company. Such printers use asymmetric heating in lieu of electrostatic charging tunnels to deflect ink droplets toward desired locations on the recording medium. In this new device, a droplet generator formed from a heater having a selectively-actuated section associated with only a portion of the nozzle bore perimeter is provided for each of the ink nozzle bores. Periodic actuation of the heater element via a train of uniform electrical power pulses creates an asymmetric application of heat pulses to the stream of droplets to control the direction of the stream between a print direction and a non-print direction.

While such continuous inkjet printers have demonstrated many proven advantages over conventional inkjet printers utilizing electrostatic charging tunnels, the inventors have noted certain areas in which such printers may be improved.

In particular, for reasons not entirely understood, the inventors have noted that some ink droplets may become misdirected during the printing operation, and either strike the printing medium when they should have been captured by the gutter, or vice versa. While the incidence of such misdirected droplets is small, any such misdirection frustrates the goal of 100% accuracy in the printing operation. The inventors have also observed that a possible solution to the problem of droplet misdirection might be the replacement of water-based inks with inks based upon organic solvents such as isopropanol. Such organic solvents have a higher volatility and lower heat capacity than water. Hence, a stream of ink based on such solvents will deflect more sharply in response to heat pulses generated by the heater placed adjacent to the nozzle outlet. Unfortunately, the use of inks based on such organic solvents generates environmental problems since such solvents are more hostile to the environment and more expensive to dispose of than water-based inks.

Clearly, there is a need for an improved, asymmetric heat-type inkjet printer, which is capable of increasing the angle of deflection of the ink droplets without the use of environmentally objectionable ink chemistries. Ideally, such an improvement would be simple and inexpensive to implement in existing print heat designs.

SUMMARY OF THE INVENTION

Generally speaking, the invention is an ink drop generator for printhead that overcomes or ameliorates all of the aforementioned disadvantages associated with the prior art. To this end, the invention comprises an inkjet printhead having at least one nozzle for continuously ejecting a stream of ink that forms a train of ink droplets; a heater disposed adjacent to the nozzle for selectively thermally deflecting the droplet-forming stream of ink, and a steering fluid assembly for providing a film of fluid around the droplet-forming stream that is more deflective in response to heat pulses generated by the heater than the ink.

The steering fluid assembly may include a pair of bores in the inkjet printhead which communicate with opposing sides of the side walls of the nozzle for uniformly injecting a film of steering fluid around the droplet-forming ink stream such that a co-extruded jet is formed comprising a cylindrical core of ink surrounded by an annular film of steering fluid. In the preferred embodiment of the droplet generator, the ink is an aqueous-based mixture, and the steering fluid is a liquid having a higher volatility and lower thermal diffusivity than the ink. The steering fluid may be one of the group consisting of alcohols, glycols, surfactants, and micro-emulsions. Specific compounds suitable for use as steering fluids include polypropylene oxide, polyethylene oxide, and isopropanol.

The fluid-conducting bores of the steering fluid assembly are each connected to a pressurized supply of steering fluid so that a co-extruded stream of steering fluid and ink is produced. In one preferred method of the invention, the flow rate of the steering fluid is adjusted relative to that of the stream of ink ejected from the outlet of the nozzle so that an annular film of steering fluid between 0.1 and 1.0 microns in depth surrounds a cylindrical stream of ink approximately 8 microns in diameter. In another preferred method, only one of the bores of the steering fluid assembly is used to introduce steering fluid into the stream, which results in an asymmetric co-extended stream of ink and steering fluid. In this mode of operation, the bore that introduces the steering fluid is preferably placed on the same side of the nozzle as the heater to ensure that the resulting, co-extruded stream includes a film of steering fluid on the side of the stream nearest the heater. In a third preferred method, steering fluid is introduced through only one bore of the steering fluid assembly whenever deflection is needed. Hence, droplet deflection occurs as a result of the modulation of the flow of steering fluid through a single bore. In this method, the location of the bore need not depend on the location of the heater, as the heater is not used to deflect the stream.

By increasing the angle of deflection of the ink stream by the heater, the inkjet printhead of the invention may be more closely positioned to the printing medium, thereby increasing the accuracy (and hence clarity) and speed of the printing operation. The use of only a thin film of steering fluid minimizes any adverse environmental effects associated with the use of volatile organic liquids.

BRIEF DESCRIPTION OF THE DRAWINGS

Reference is made to the accompanying drawings in which.

DETAILED DESCRIPTION OF THE INVENTION

The invention is an improvement of a continuous inkjet printer system that uses an asymmetric application of heat around an inkj et nozzle to achieve a desired ink drop deflection. In order for the invention to be completely understood, an overall description of such an inkj et printer system will first be given.

Figure 1:
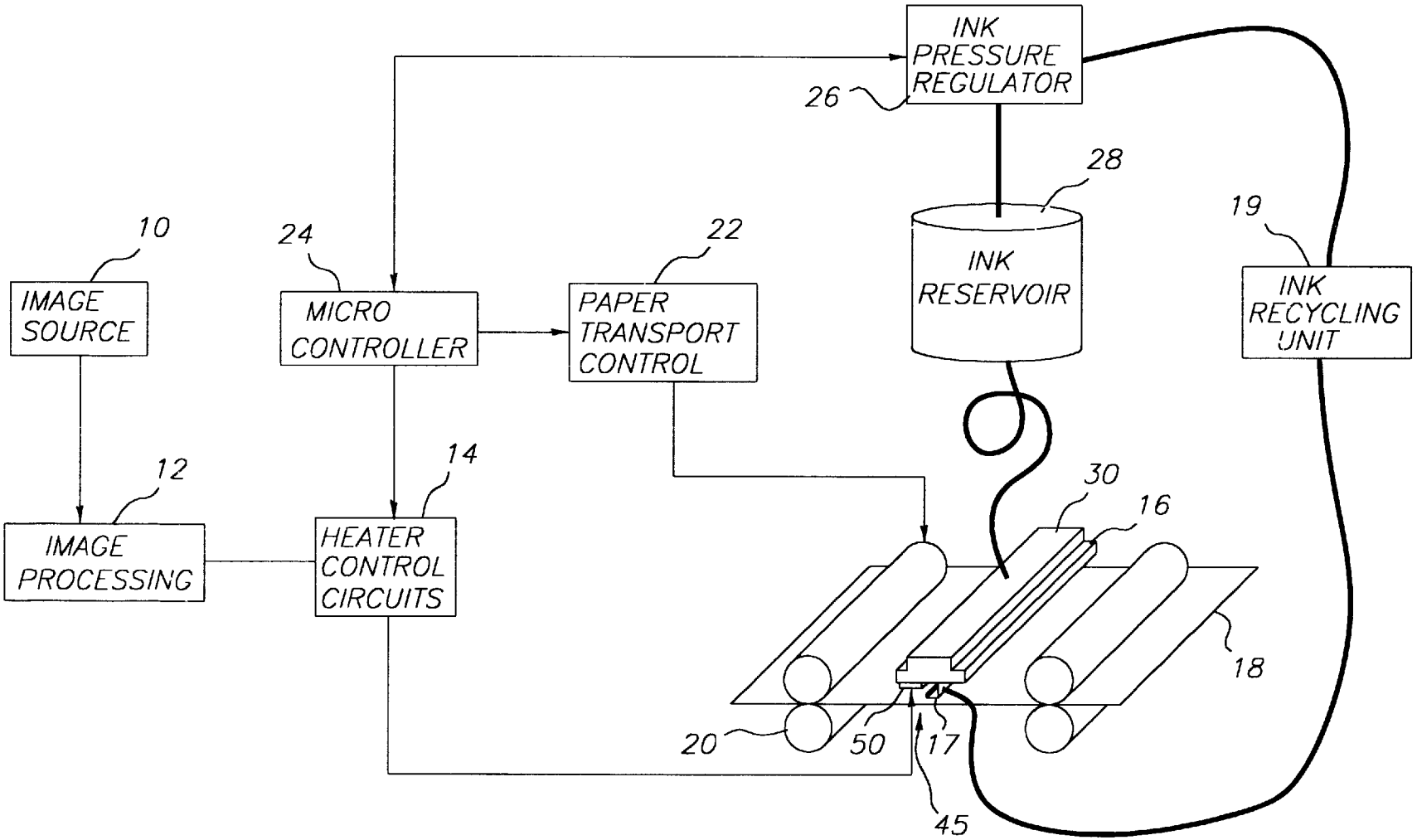
FIG. 1 is a simplified, block schematic diagram of one exemplary printing apparatus according to the present invention.

Referring to FIG. 1, an asymmetric heat-type continuous ink jet printer system 1 includes an image source 10 such as a scanner or computer which provides raster image data, outline image data in the form of a page description language, or other forms of digital image data. This image data is converted to half-toned bitmap image data by an image processing unit 12, which also stores the image data in memory. A heater control circuit 14 reads data from the image memory and applies electrical pulses to a heater 50 that applies heat pulses to a nozzle 45 that is part of a printhead 16. These pulses are applied at an appropriate time, and to the appropriate nozzle 45, so that drops formed from a continuous ink jet stream will print spots on a recording medium 18 in the appropriate position designated by the data in the image memory.

Recording medium 18 is moved relative to printhead 16 by a recording medium transport system 20 which is electronically controlled by a recording medium transport control system 22, and which in turn is controlled by a microcontroller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 (also shown in FIG. 2) that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles 45 and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface where a plurality of nozzles and heaters are situated. With printhead 16 fabricated from silicon, it is possible to integrate heater control circuits 14 with the printhead.

Figure 2:
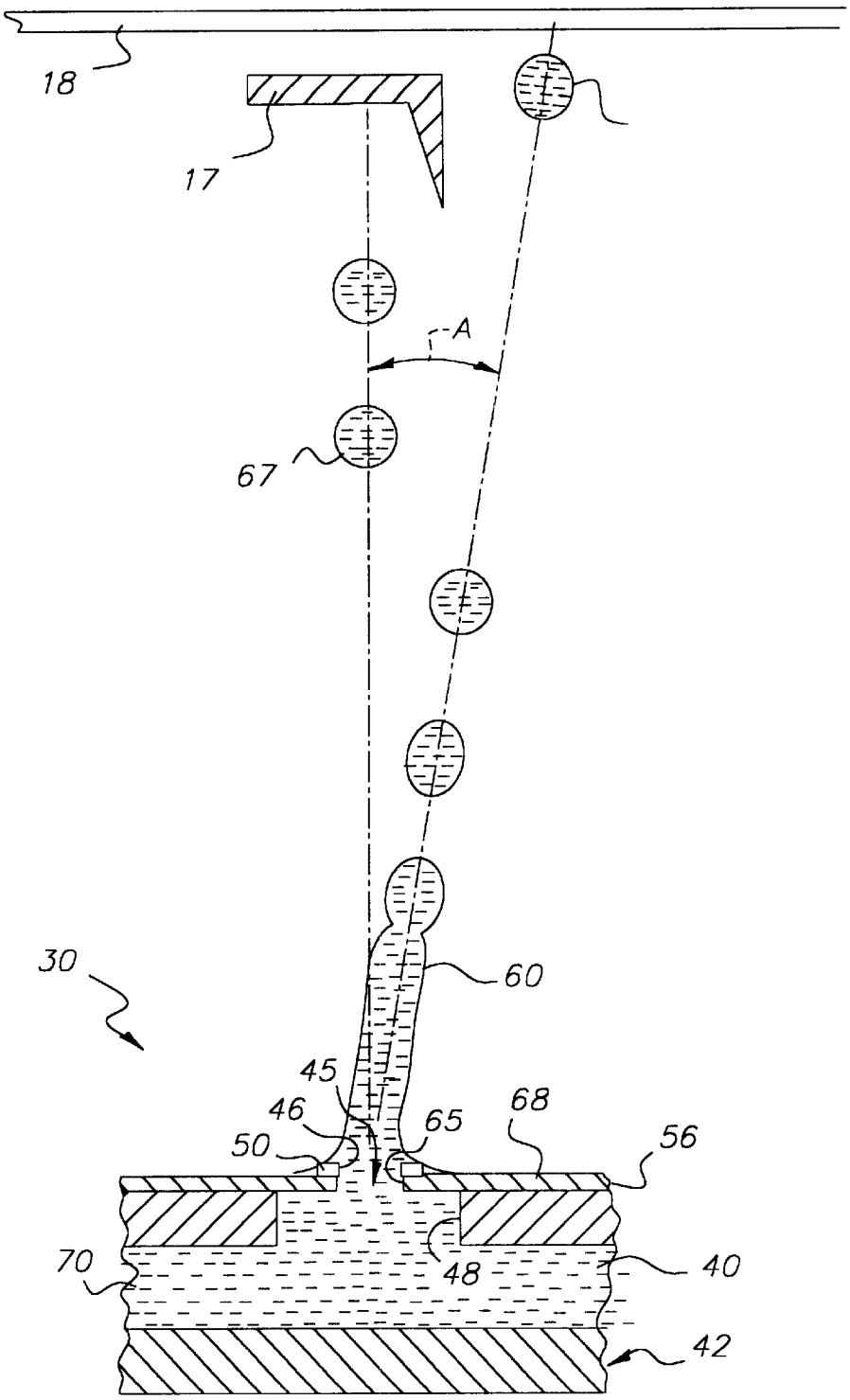
FIG. 2 is an enlarged, cross-sectional side view of one of the nozzles of the printhead illustrated in FIG. 1, illustrating how the ink droplets generated thereby are deflected over an angle A in response to heat pulses.

FIG. 2 is a cross-sectional view of a nozzle 45 in operation. An array of such nozzles 45 form the continuous ink jet printhead 16 of FIG. 1. An ink delivery channel 40, along with a plurality of nozzle openings 46 are etched in a substrate 42, which is silicon in this example. Delivery channel 40 and nozzle openings 46 may be formed by anisotropic wet etching of silicon, using a $p^+$ etch stop layer to form the nozzle openings. Ink 70 in delivery channel 40 is pressurized above atmospheric pressure, and forms a stream 60. At a distance above nozzle opening 46, stream 60 breaks into a plurality of drops 66 due to heat supplied by a heater 50.

Figure 3A:
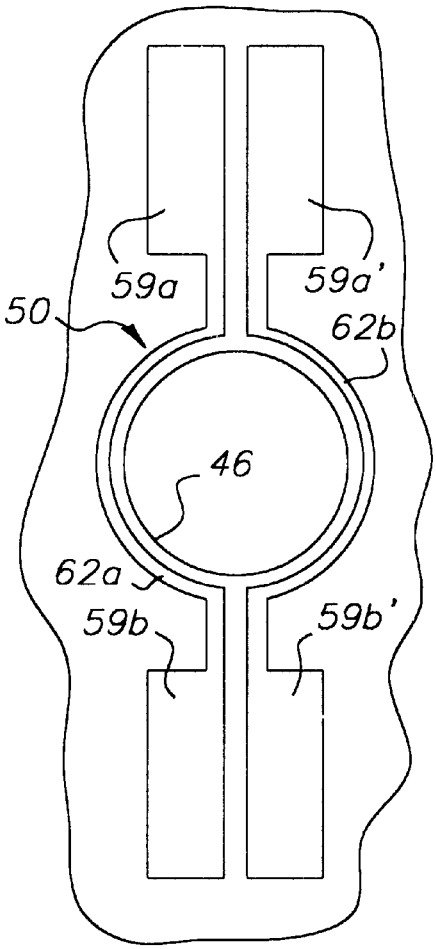
FIGS. 3A and 3B are plan views of two different embodiments of heaters used in conjunction with the printing apparatus illustrated in FIG. 1.
Figure 3B:
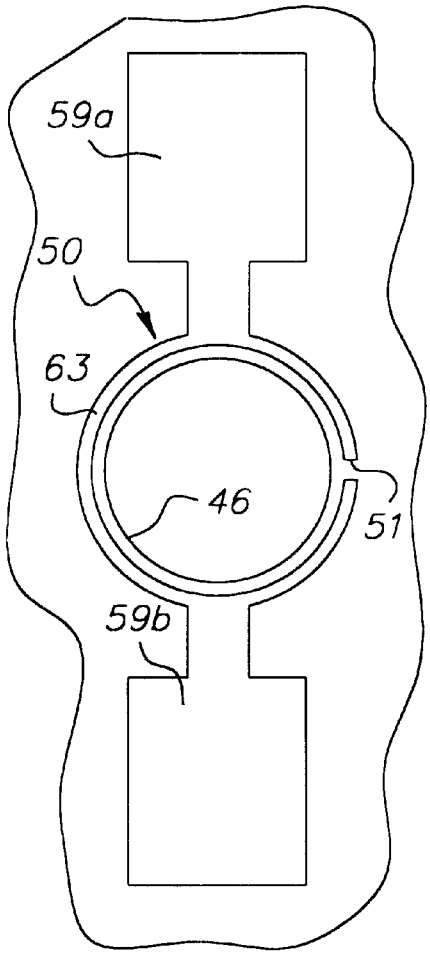

With reference now to FIG. 3A, the heater 50 has a pair of semicircular sections 62*a,b,* each of which covers approximately one-half of the nozzle perimeter. Each heater section 62*a,b* terminates on either end in connections 59*a,b* and 59'*a,b,* respectively. An alternative geometry is shown in FIG. 3B. In this geometry the nozzle opening 46 is almost entirely surrounded by the heater 50 except for a small missing section 51. Missing section 51 acts as an electrical open circuit such that only approximately one-half of the heater 50 is electrically active since the current flowing between connections 59*a* and 59*b* needs to travel only around the left half of the annulus to complete the active circuit. In both embodiments, power connections 59*a* and 59*b* transmit electrical pulses from the drive circuitry 14 to the heater 50. Stream 60 is deflected by the asymmetric application of heat generated on the left side of the nozzle opening by the heater sections 62*a* and 63 shown in FIGS. 3A and 3B, respectively. In the FIG. 3A embodiment, heater section 62*b* provides extra capability and control. of ink drop formation and deflection. For example, current may be introduced through connections 59'*a,b* to provide for more uniform pinning of the ink stream 60 as it emerges from nozzle opening 46. This technology is distinct from that electrostatic continuous stream deflection printers which rely upon deflection of charged drops previously separated from their respective streams. With stream 60 being deflected, drops 66 may be blocked from reaching recording medium 18 by a cut-off device such as an ink gutter 17. In an alternate printing scheme, ink gutter 17 may be placed to block undeflected drops 67 so that deflected drops 66 will be allowed to reach recording medium 18.

The heater 50 may be made of polysilicon doped at a level of about 30 ohms/square, although other resistive heater materials could be used. Heater 50 is separated from substrate 42 by thermal and electrical insulating layer 56 to minimize heat loss to the substrate. The nozzle opening 46 may be etched allowing the nozzle exit orifice to be defined by insulating layers 56.

The layers in contact with the ink can be passivated with a thin film layer 65 for protection. The printhead surface can be coated with a hydro-phobizing layer 68 to prevent accidental spread of the ink across the front of the printhead.

Heater control circuit 14 supplies electrical power to the heater 50 as shown in FIG. 2 in the form of an electrical pulse train. Control circuit 14 may be programmed to supply power to the semicircular section of the heater 50 in the form of pulses of uniform amplitude, width, and frequency or varying amplitude, width, or frequency. As illustrated in FIG. 2, deflection of an ink droplet in the amount of angle @A@ occurs whenever an electrical power pulse is supplied to the heater 50. As will be described in more detail with respect to FIG. 5, the invention advantageously causes the ink droplets to deflect a layer angle @B@ which is larger than angle A whenever a heat-generating electrical power pulse is applied to the heater 50.

Figure 4A:
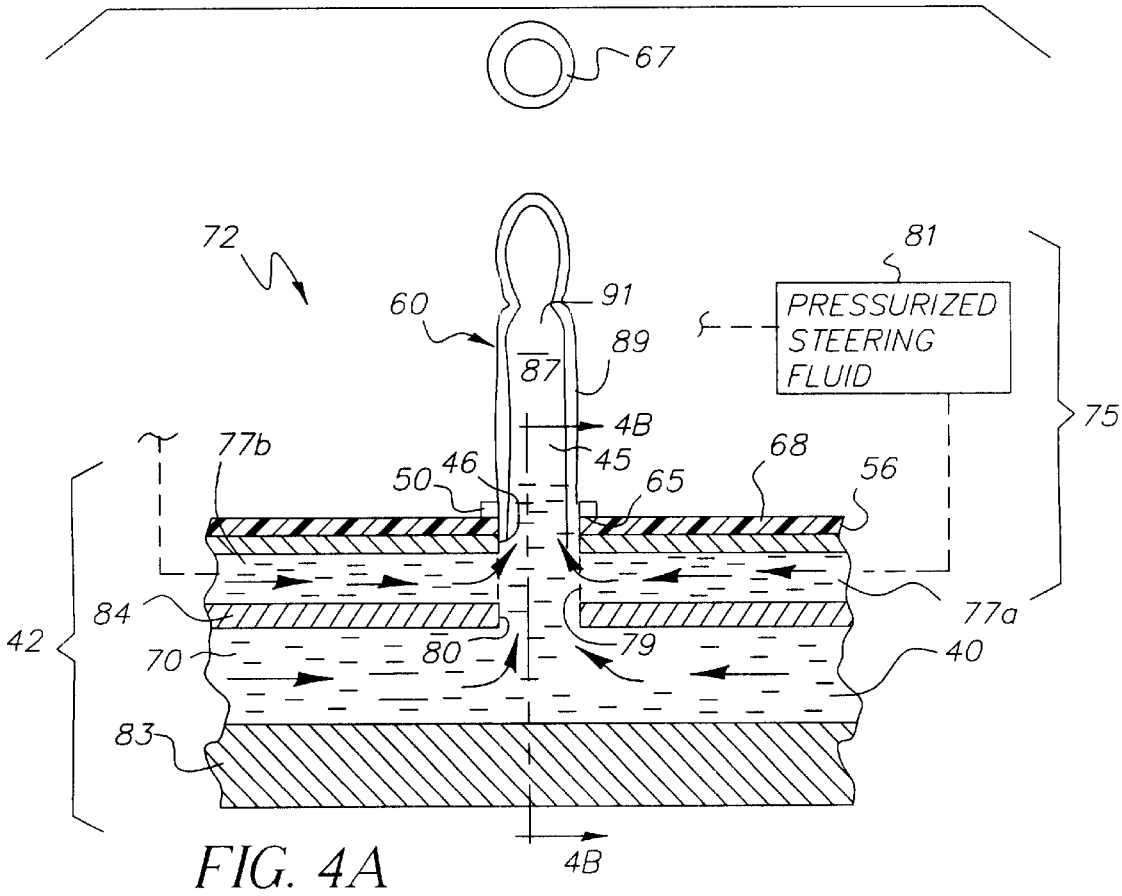
FIG. 4A is a cross-sectional side view of a printhead that incorporates the steering fluid assembly of the invention, illustrating how the steering fluid assembly co-extrudes a thin film of steering fluid around the stream of ink ejected from the nozzle opening.
Figure 4B:
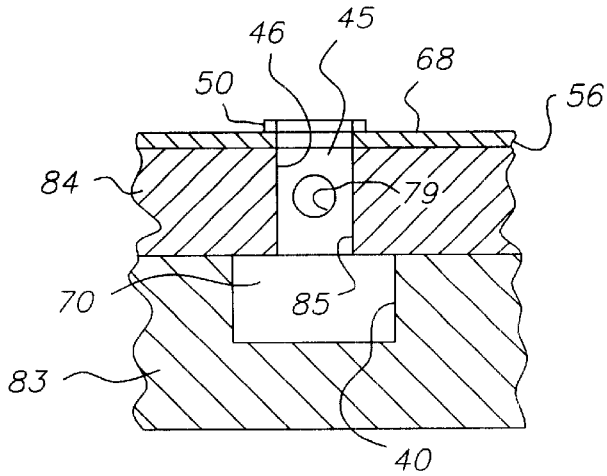
FIG. 4B is another cross-sectional side view of the nozzle illustrated in FIG. 4A along the line 4B—4B.

FIGS. 4A and 4B illustrate the improved printhead 72 of the invention. This improved printhead includes a steering fluid assembly 75 which operates to apply a thin, film of steering film either around or on one side of the stream of ink that is continuously ejected from the nozzle opening 46. The steering fluid assembly 75 includes a pair of opposing bores 77*a,b* each of which has an outlet 79 disposed in opposing side walls 80 of the nozzle 45. Each of these bores 77*a,b* is fluidly connected to a pressurized source of steering fluid 81 (as indicated in schematic).

One of the bores 77*a,b* is adjacent to the active portion of the heater 50. The substrate 42 of the improved printhead 72 includes a lower substrate layer 83 and an upper substrate layer 84. The lower substrate layer 83 includes an ink delivery channel 40 for delivering a pressurized and preferably aqueous ink to the nozzle 45. The upper substrate layer 84 includes the previously-described bores 77*a,b* for conducting steering fluid to the nozzle 45. The division of the substrate 42 into lower and upper substrate layers 83 and 84 simplifies the manufacture of the improved printhead 72.

Another difference between the improved printhead 72 and the previously-described printhead 16 is the aspect ratio of the nozzles 45. Specifically, in the printhead 16, the diameter of the side walls 48 of the nozzles 45 is greater than the nozzle opening 46. By contrast, the diameter of the side walls 80 of each nozzle 45 in the improved printhead 72 is the same diameter as the nozzle outlet 46. Such dimensioning is necessary to obtain a uniform co-extrusion between the steering fluid and the ink, as will be described directly. Finally, it should be noted that while the diameter of the bore outlets 79 in the preferred embodiment is approximately 3 to 4 microns, this diameter can be as large as the diameter of the nozzle outlet 46 itself, which is approximately 10 microns.

In one mode of operation, steering fluid from source 81 is provided in the two bores 77*a,b,* while a pressurized and preferably water-based ink is provided via the ink delivery channel 40. The resulting flow of fluids results in a co-extruded column 87 formed from an annular layer of steering fluid 89 surrounding a cylindrical core of ink 91. The pressure of the steering fluid source 81 and the diameters of the bores 77*a,b* and outlets 79 should be chosen such that the annular film of steering fluid 89 is between about 0.10 and 1.0 microns in thickness. If the layer 89 of steering fluid is thinner than 0.1 microns, it may lose its ability to significantly add to the deflection of the column 87 when a heat pulse is generated by the heater 50. If the thickness of the steering fluid layer 89 is much greater than 1 micron, then an unnecessarily high percent of the liquid forming the ink droplets 67 will be taken up by the steering fluid which is likely to be more harmful to the environment than a water-based ink.

Alternatively, steering fluid may be provided through only one of the bores 77*a* or 77*b*. Such a mode of operation produces a co-extended stream which is asymmetric such that the layer of steering fluid is only on one side of the co-extended stream. However, such a mode of operation would still effectively deflect the resulting droplets. In one mode of this type of operation, the bore 77*a* or 77*b* chosen to introduce the steering fluid is the one closest to the heater 50 so that the resulting diffusion of the layer of steering fluid will have a maximum impact in deflecting the co-extended stream. In another mode of this type of operation, the introduction of the steering fluid is modulated through a selected one of the bores 77*a* or 77*b* in order to selectively deflect the co-extended stream. In the latter mode of operation, the bore 77*a* or 77*b* need not be selected with respect to the location of the heater 50 since the heater is not used to selectively deflect the resulting ink droplets.

The steering fluid contained within the source 81 should have a higher volatility and lower thermal diffusivity than the fluid forming the ink 70. Upon application of the same amount of thermal energy to steering fluid and the ink, the surface tension of the steering fluid should decrease more rapidly than the surface tension of the ink. When the ink is water-based, the steering fluid may be an alcohol, a glycol, a surfactant, or a micro-emulsion. A preferred alcohol is isopropanol, while preferred surfactant solutions include aqueous solutions of polypropylene oxide based surfactants and co-polymers of polyethylene oxide and polypropylene oxide.

Figure 5:
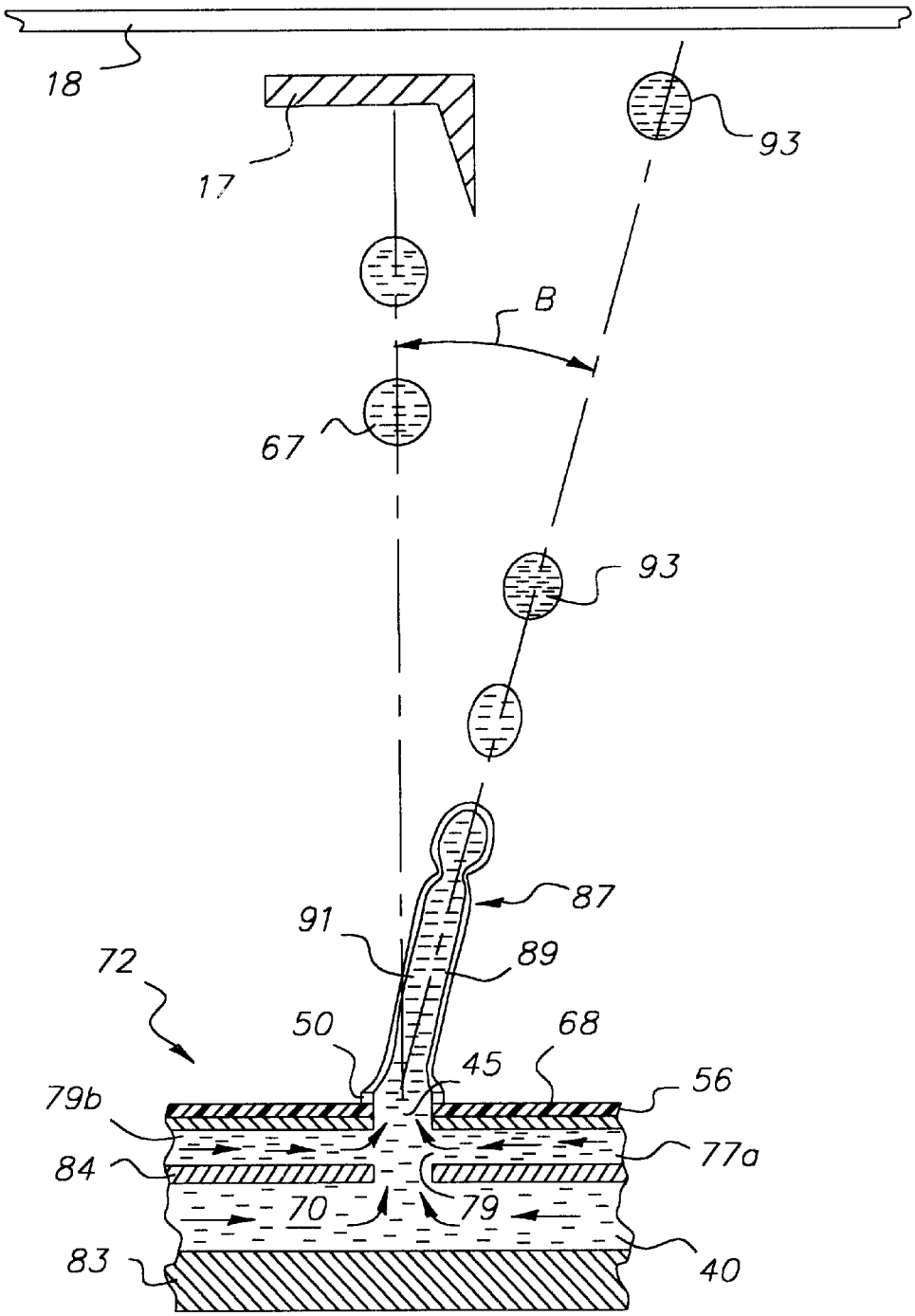
FIG. 5 illustrates how the steering fluid assembly of the invention causes ink droplets generated by the nozzle of the printhead to be deflected at a greater angle B in response to the heat pulses generated by the printhead heater.

FIG. 5 illustrates one preferred operation and method of the invention. Here, pressurized steering fluid is being introduced into the bores 77*a,b* while pressurized ink 70 is introduced through channel 40. The resulting coextruded column 87 of ink 91 surrounded by an annular film 89 of steering fluid deflects in angle B in response to a heat pulse generated by heater 50 when an electrical pulse is conducted through it. A comparison of FIGS. 2 and 5 will demonstrate that deflection angle B is substantially larger than deflection angle A associated with an unimproved asymmetric heat-type printhead. The greater angle of deflection B greatly reduces the probability that a deflected ink droplet 93 intended to strike the recording medium 18 will instead strike (either completely or glancingly) the gutter 17, and vice versa. Printing errors are reduced. Additionally, the greater angle of deflection B allows the recording medium 18 to be brought closer to the nozzles 45 of the improved printhead 72. This is also advantageous, as gravity and air resistance has less time to cause the trajectories of the ink droplets 93 to drop from their intended striking points on the recording medium 18, thereby further enhancing printing accuracy and resolution. Finally, the greater angle of deflection B increases potential maximum speed of the printing operation, which is limited in part by the time it takes ink droplets 67, 93 to be deflected from a gutter striking trajectory to a recording medium-striking trajectory.

Parts List

1. Printer system
10. Image source
12. Image processing unit
14. Heater control circuits
16. Printhead
17. Ink gutter
18. Recording medium
19. Ink recycling unit
20. Transport system
22. Transport control system
24. Micro-controller
26. Inkjet pressure regulator
28. Ink reservoir
30. Ink channel device
40. Ink delivery channel
42. Substrate
45. Nozzle
46. Nozzle opening
48. Nozzle side walls
50. Nozzle heater
51. Missing section
56. Electrical insulating layer
59. Connectors a,b
60. Stream
62. Semicircular heating elements a,b
63. Annular heating element
64. Break in heating element.
65. Thin passivity film
66. Drops (deflected)
67. Undeflected drops
68. Hydrophobizing layer
70. Ink
72. Improved printhead
75. Steering fluid assembly
77. Bores a,b
79. Outlet
80. Side walls
81. Pressurized source of steering fluid
83. Lower substrate layer
84. Upper substrate layer
87. Co-extruded steering fluid
89. Layer of steering fluid
91. Core of ink
93. Deflected droplets

What is claimed is:

1. A droplet generator comprising:

an inkjet printhead having at least one nozzle for continuously ejecting a stream of ink that forms a train of ink droplets, portions of said printhead defining an ink delivery channel connected to said at least one nozzle;

a heater disposed adjacent to said at least one nozzle for selectively thermally deflecting said droplet-forming stream of ink; and a steering fluid assembly in communication with said nozzle for providing a film of fluid on at least one side of said droplet-forming stream that is more deflective in response to heat generated by a heater than said ink, wherein at least a portion of said steering fluid assembly is positioned within said inkjet printhead and between said delivery channel and said heater.

2. The droplet generator defined in claim 1, wherein said ink is a substantially aqueous mixture, and said steering fluid is a liquid having a higher volatility and a lower diffusivity than said ink.

3. The droplet generator defined in claim 2, wherein the application of said heat reduces the surface tension of said steering fluid more than said heat reduces the surface tension of said ink.

4. The droplet generator defined in claim 2, wherein said steering fluid assembly includes a pair of bores in said inkjet printhead in communication with opposing sides of said nozzle for uniformly injecting said film of fluid around said droplet forming stream.

5. The droplet generator defined in claim 4, wherein said bores are in substantial alignment with a midpoint of said heater.

6. The droplet generator defined in claim 1, wherein said steering fluid is one of the group consisting of alcohols, glycols, surfactants, and micro-emulsions.

7. The droplet generator defined in claim 6, wherein said steering fluid is one of the group consisting of polypropylene oxide, surfactants, and copolymers of polyethylene oxide.

8. The droplet generator defined in claim 6, wherein said steering fluid is isopropanol.

9. The droplet generator defined in claim 1, wherein said steering fluid assembly includes a pressurized supply of steering fluid for providing steering fluid to said droplet-forming stream at a rate that causes said film to be at least 0.1 micron in thickness.

10. A droplet generator comprising:

an inkjet printhead having at least one nozzle for continuously ejecting a stream of ink that forms a train of ink droplets, said at least one nozzle being connected in fluid communication to an ink delivery channel;

a heater disposed on said inkjet printhead adjacent to said at least one nozzle for selectively thermally deflecting said droplet-forming stream of ink, and a steering fluid assembly for providing a film of fluid on at least one side of said droplet-forming stream that is more deflective in response to heat generated by said heater than said ink, including at least one bore in said printhead having an outlet in communication with said nozzle, and a source of pressurized steering fluid connected to said bore, wherein at least a portion of the steering fluid assembly is positioned between the delivery channel and the heater.

11. The droplet generator defined in claim 10, wherein said heater includes a heating element disposed on one side of said nozzle, and wherein said bore outlet is disposed on the same side of said nozzle as said heating element.

12. The droplet generator defined in claim 10, wherein said steering fluid source includes means for providing steering fluid to said nozzle at a rate that causes said fluid film to be at least 0.1 micron in thickness, said film circumscribing said droplet-forming stream of ink.

13. The droplet generator defined in claim 10, wherein said nozzle has an opening for ejecting said stream of ink, and wherein said bore outlet of said steering fluid assembly has an area between about 20% and 100% of an area of said nozzle opening.

14. The droplet generator defined in claim 10, wherein said ink is a substantially aqueous mixture, and said steering fluid is a liquid having a higher volatility and a lower thermal diffusivity than said ink.

15. The droplet generator defined in claim 14, wherein the application of said heat reduces the surface tension of said steering fluid more than said heat reduces the surface tension of said ink.

16. The droplet generator defined in claim 10, wherein said steering fluid is one of the group consisting of alcohols, glycols, surfactants, and micro-emulsions.

17. A method for increasing the thermal deflectivity of an ink stream in an asymmetric heat-type inkjet printer, comprising the steps of:

providing a film of a steering fluid on at least one side of said ink stream prior to applying asymmetric heat to said ink stream, wherein said steering fluid is a liquid having a higher volatility and a lower thermal diffusivity than said ink.

18. The method defined in claim 17, wherein said steering fluid film is at least 0.1 micron in thickness.

19. The method defined in claim 17, wherein said film is applied more thickly to a side of said ink stream adjacent to a nozzle heater of said inkjet printer.

20. A droplet generator comprising:

a printhead having a delivery channel in communication with a nozzle, the nozzle having an outlet for ejecting a stream of ink from the printhead;

a steering fluid assembly in communication with the nozzle for providing a film of fluid on at least one side of the ejected stream; and a heater positioned on the printhead adjacent to the outlet of the nozzle, wherein at least a portion of the steering fluid assembly is positioned between the delivery channel and the heater.

21. The droplet generator defined in claim 20, wherein the steering fluid assembly includes a source of fluid that is more deflective than the ink of the stream in response to heat generated by the heater.

22. The droplet generator defined in claim 20, wherein the steering fluid assembly includes a pair of bores in communication with opposing sides of the nozzle such that the film of fluid is provided around the stream of ink.

23. The droplet generator defined in claim 22, wherein the steering fluid assembly provides fluid through one bore of the pair of bores.

24. The droplet generator defined in claim 23, the heater having an active portion, wherein the active portion of the heater is positioned on the printhead adjacent to the nozzle on the same side of the nozzle as the one bore.

* * * * *